US005722766A

United States Patent [19]

Shu

[11] Patent Number: 5,722,766

[45] Date of Patent: Mar. 3, 1998

[54] SECURE LIGHT BULB HOLDER ASSEMBLY

[76] Inventor: Kuo Fen Shu, No. 10, Lane 198, Chung Cheng Road, Hsinchu, Taiwan

[21] Appl. No.: 714,616

[22] Filed: Sep. 16, 1996

[51] Int. Cl.[6] ..... H01R 33/00

[52] U.S. Cl. ..... 362/226; 362/249; 362/806

[58] Field of Search ..... 362/226, 267, 362/391, 806, 249, 294

[56] References Cited

U.S. PATENT DOCUMENTS 5,368,503 11/1994 Savage, Jr. ..... 439/502
5,605,395 2/1997 Peng ..... 362/226

*Primary Examiner*—Stephen F. Husar
*Attorney, Agent, or Firm*—Morton J. Rosenberg; David I. Klein; Jun Y. Lee

[57] ABSTRACT

A light bulb holder assembly includes a base connecting with a cap having engaged with a light bulb wherein a groove is formed on the cap and a plate is provided in the base which can be engaged within the groove of the cap when the cap being engaged within the base to separate a set of a conducting wire and a conductor from another set that provides two independent areas for infiltrating water drag and prevents from resulting in a short circuit.

1 Claim, 4 Drawing Sheets

SECURE LIGHT BULB HOLDER ASSEMBLY

BACKGROUND OF THE INVENTION

Usually, a light string is used outdoor and often subject to rain. It is inevitable to have some water infiltrating into the base. If water stay inside the base, it may erode the conductors resulting in a short circuit. Prior art fastening systems for decorative light bulb holders generally use a tight or force fit between a cap and a base, however, such a connection does not provide for secure coupling and loosening often occurs and can not prevent from water infiltrating that results in a short circuit and damages the light string.

SUMMARY OF THE INVENTION

In view of the above drawback, the primary object of the present invention is to provide an improved cap and base structure which can drain water from the base mad prevent from resulting in a short circuit, eliminating the drawback of the said prior systems.

BRIEF DESCRIPTION OF THE ACCOMPANYING DRAWINGS

DETAILED DESCRIPTION OF THE EMBODIMENTS

Figure 1:
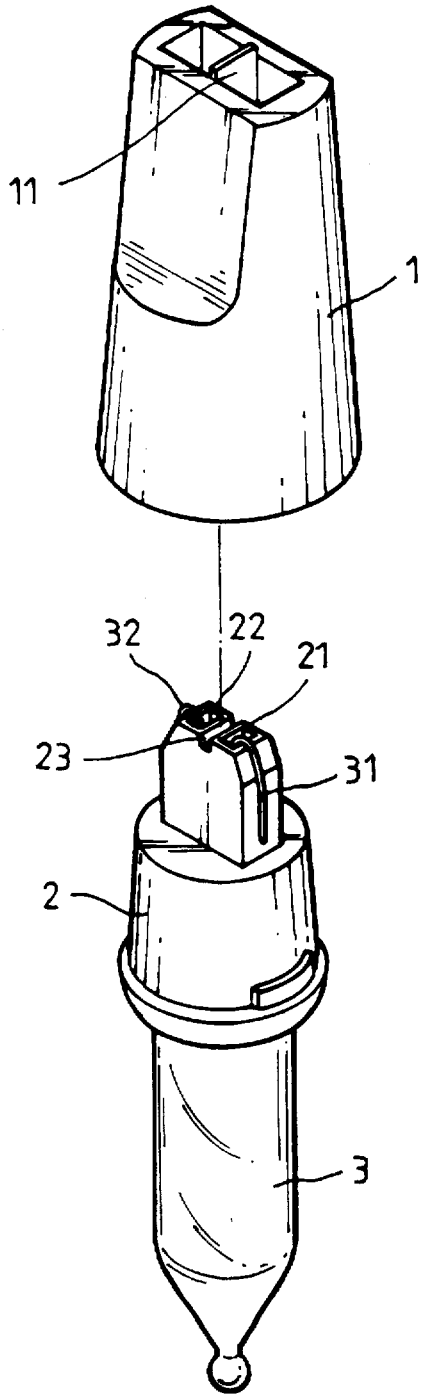
FIG. 1 is a perspective view showing an embodiment of the invention.
Figure 2:
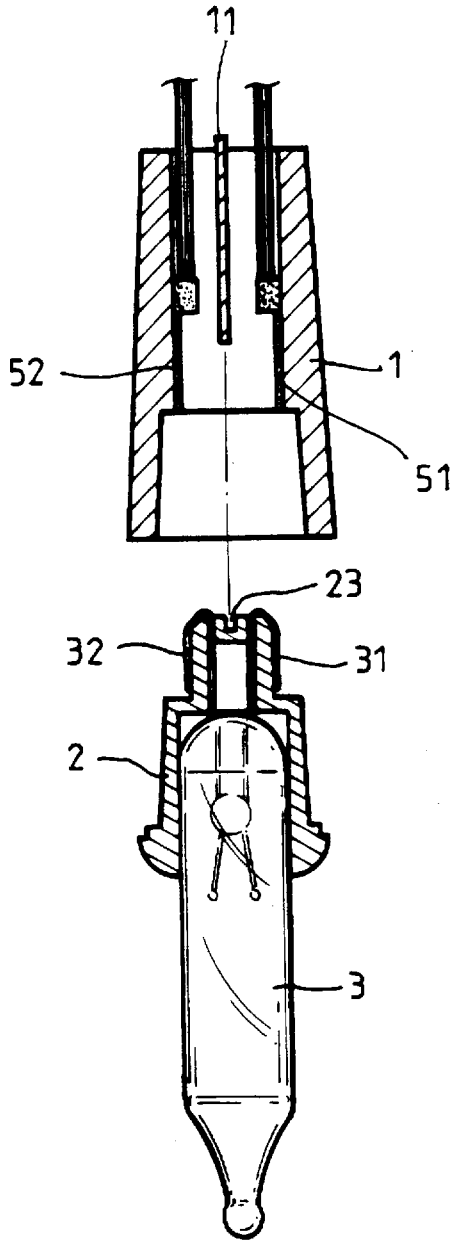
FIG. 2 is a sectional view of the embodiment according to the invention.
Figure 3:
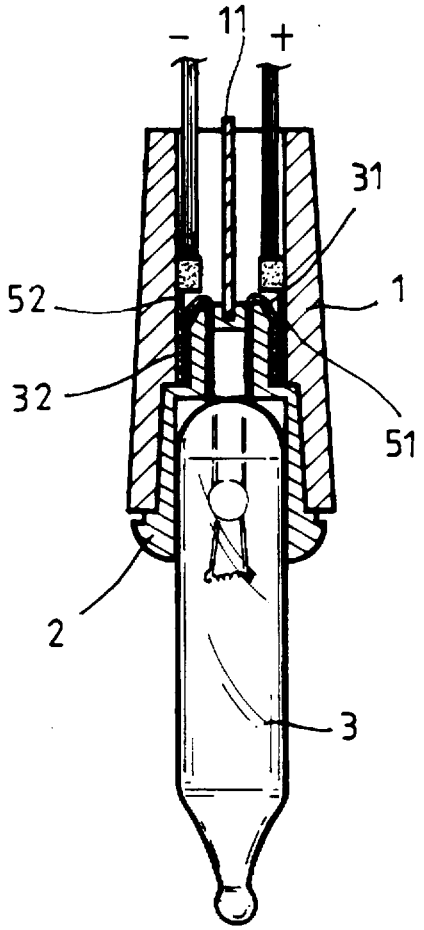
FIG. 3 is a sectional view of the embodiment in assembly of FIG. 2.

Referring to FIGS. 1 to 3, there are shown the light bulb holder assembly including a base 1, a cap 2, and a light bulb

3. The bulb 3 is connected within the cap 2 while two conducting wires 31, 32 of the bulb 3 are passing through a pair of holes 21, 22 formed on the end of the cap 2 as a prior known light bulb structure. The characteristics of the present invention are to provide a groove 23 which is formed between the two holes 21, 22 on the end of the cap 2 and to provide a plate 11 in the base 1. When the cap 2 as well as the bulb 3 is connected within the base 1, the inner end of the plate 11 is therefore engaged with the groove 23 of the cap 2 to separate the conducting wire 31 which contacts a conductor 51, for example positive pole, from the other conducting wire 32 which contacts another conductor 52, for example negative pole.

Figure 4:
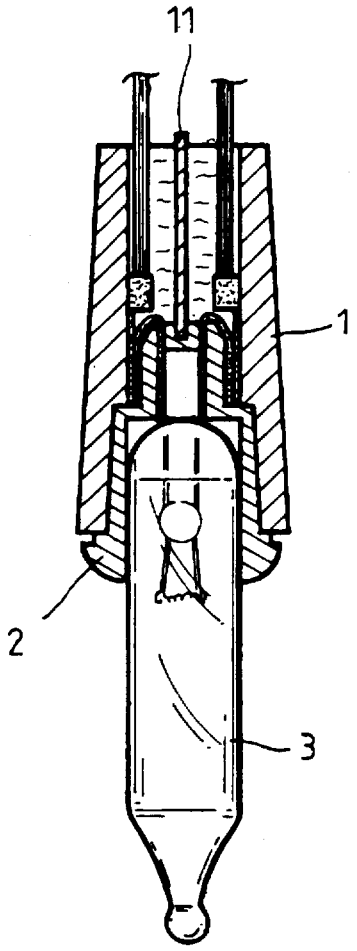
FIG. 4 is an exemplified embodiment of FIG. 3.

According to above structure of this invention, as the rain comes into the base 1, as shown in FIG. 4, the infiltrating water will never be in contact with two conductors or two conducting wires at the same time and will be drained from chinks between the cap 2 and the base 1. It can be obviously understood that a short circuit is then prevented.

I claim:

1. A secure light bulb holder assembly including a light bulb having its one end inserting into a cap while a pair of conducting wires formed on the bulb are passing through a pair of holes formed on the cap, and the cap as well as the light bulb being engaged within a base; characterized in that:

a groove is formed between the two holes of the cap and a plate is formed in the base; while the cap is engaged within the base, the inner end of the plate is then engaged within the groove to separate one conducting wire from the other, that provides two independent areas to prevent from a short circuit when water or rain infiltrating.

* * * * *